US010379461B2

(12) United States Patent
Eto

(10) Patent No.: US 10,379,461 B2
(45) Date of Patent: Aug. 13, 2019

(54) TONER CONTAINER, IMAGE FORMING APPARATUS

(71) Applicant: KYOCERA Document Solutions Inc., Osaka-shi, Osaka (JP)

(72) Inventor: Daisuke Eto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/163,880

(22) Filed: Oct. 18, 2018

(65) Prior Publication Data

US 2019/0121258 A1 Apr. 25, 2019

(30) Foreign Application Priority Data

Oct. 20, 2017 (JP) ..... 2017-203376

(51) Int. Cl.
*G03G 15/08* (2006.01)

(52) U.S. Cl.
CPC ..... *G03G 15/0879* (2013.01); *G03G 15/0874* (2013.01); *G03G 15/0887* (2013.01)

(58) Field of Classification Search
CPC ..... G03G 15/0879; G03G 15/0874; G03G 15/0887; G03G 15/0822; G03G 15/0865; G03G 15/0877; G03G 2215/066
USPC ..... 399/358
See application file for complete search history.

(56) References Cited

U.S. PATENT DOCUMENTS 6,201,941 B1 3/2001 Kasahara et al.
6,826,381 B2 11/2004 Muramatsu et al.
7,650,103 B2 1/2010 Isomura
9,360,816 B1 * 6/2016 Mabuchi ..... G03G 15/0879
2005/0163537 A1 7/2005 Muramatsu et al.
2006/0051136 A1 * 3/2006 Tsuda ..... G03G 15/0879 399/258
2007/0003325 A1 1/2007 Jung et al.
2007/0009289 A1 1/2007 Muramatsu et al.
2007/0274740 A1 * 11/2007 Katoh ..... G03G 15/0879 399/254
2009/0185832 A1 7/2009 Muramatsu et al.
2011/0081168 A1 * 4/2011 Kimura ..... G03G 15/0879 399/258
2011/0255907 A1 * 10/2011 Mihara ..... G03G 15/0879 399/263
2013/0272750 A1 * 10/2013 Matsumoto ..... G03G 15/0879 399/262
2013/0322927 A1 * 12/2013 Matsumoto ..... G03G 15/0879 399/258
2014/0368586 A1 12/2014 Usui et al.
(Continued)

FOREIGN PATENT DOCUMENTS

JP 2005195659 A 7/2005

*Primary Examiner* — Sophia S Chen

(74) *Attorney, Agent, or Firm* — Alleman Hall Creasman & Tuttle LLP

(57) ABSTRACT

A toner container includes a container body, a tubular body, and a screw feeder. The tubular body forms a toner conveyance path communicating with an inside of the container body. The screw feeder feeds toner in the container body to the toner conveyance path by being rotationally driven inside the container body. The screw feeder pushes toner that has arrived inside the toner conveyance path further along the toner conveyance path by feeding pressure of succeeding toner.

11 Claims, 9 Drawing Sheets

(56) References Cited

U.S. PATENT DOCUMENTS

2015/0346638 A1* 12/2015 Mizusawa ..... G03G 15/0891
399/358

* cited by examiner

TONER CONTAINER, IMAGE FORMING APPARATUS

INCORPORATION BY REFERENCE

This application is based upon and claims the benefit of priority from the corresponding Japanese Patent Application No. 2017-203376 filed on Oct. 20, 2017, the entire contents of which are incorporated herein by reference.

BACKGROUND

The present disclosure relates to a toner container having a mechanism for feeding toner from a container body, and an image forming apparatus including the toner container.

Generally, an electrophotographic image forming apparatus includes a removably attached toner container. The toner container may be also referred to as a toner box.

The toner container includes a container body for storing toner, and a screw feeder for feeding the toner from the container body. The toner fed from the container body is supplied to a developing device.

In addition, according to a known technology, toner inside the container body of the toner container is conveyed to the developing device by an air flow or a powder pump.

SUMMARY

A toner container according to an embodiment of the present disclosure includes a container body, a tubular body, and a screw feeder. The container body stores toner. The tubular body forms a toner conveyance path communicating with an inside of the container body. The screw feeder includes a shaft and a blade, wherein the shaft is formed extending from inside the container body toward an entrance of the toner conveyance path, and the blade is formed protruding spirally from the shaft. The screw feeder feeds the toner in the container body to the toner conveyance path by being rotationally driven inside the container body, and pushes the toner that has arrived inside the toner conveyance path further along the toner conveyance path by feeding pressure of succeeding toner.

An image forming apparatus according to another embodiment of the present disclosure includes a developing device and the toner container. The developing device develops an electrostatic latent image on a photoconductor into a toner image. The toner container is removably attached to a body housing the developing device, and supplies toner to the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

Figure 1:
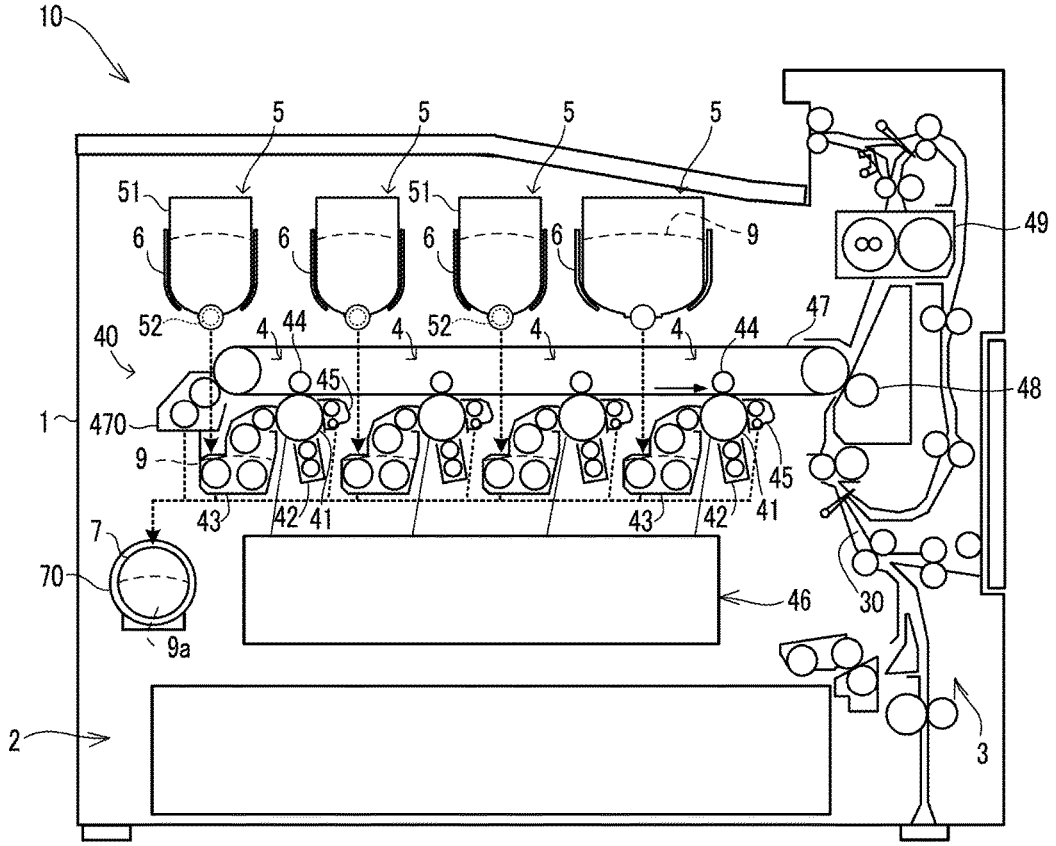
FIG. 1 is a configuration diagram of an image forming apparatus including a toner container according to a first embodiment.

As shown in FIG. 1, a plurality of toner containers 5 according to a first embodiment are attached to a body 1 of an image forming apparatus 10.

The image forming apparatus 10 is for electrophotographically forming an image on a sheet. The sheet is a sheet-like image forming medium, such as paper or resin film.

The image forming apparatus 10 includes a sheet supplying device 2, a sheet conveying device 3, a print processing device 40, an optical scanning device 46, a fixing device 49, the toner container 5, and a waste developer bottle 7.

The body 1 of the image forming apparatus 10 is a housing for storing the sheet conveying device 3, the print processing device 40, the optical scanning device 46, and the fixing device 49.

The print processing device 40 executes an image forming process for forming a toner image on the sheet. For example, the print processing device 40 executes the image forming process using a two-component developer including a toner 9 and a carrier. The carrier is a magnetic granular material.

The image forming apparatus 10 shown in FIG. 1 is a tandem type image forming apparatus and is a color printer. Accordingly, the print processing device 40 includes a plurality of imaging units 4 and a plurality of toner containers 5 corresponding to a plurality of colors of the toner 9, an intermediate transfer belt 47, a secondary transfer device 48, and a secondary cleaning device 470.

Each of the imaging units 4 includes a photoconductor 41, a charging device 42, a developing device 43, a primary transfer device 44, and a primary cleaning device 45.

The toner containers 5 are removably attached to a plurality of cartridge attaching portions 6 of the body 1, respectively. Each of the toner containers 5 includes a body 51 for storing the toner 9, and a screw feeder 52 for feeding the toner 9 from the body 51. The toner container 5 is configured to feed the toner 9 to the developing device 43 by action of the screw feeder 52. The screw feeder 52 is an example of a feeding mechanism. In addition, the body 51 is an example of a container body.

The toner 9 fed from the body 51 is supplied to the developing device 43. When the toner 9 in the body 51 of the toner container 5 is exhausted, the toner container 5 is exchanged.

The sheet supplying device 2 is configured to send the sheet to a sheet conveyance path 30 in the body 1, and the sheet conveying device 3 is configured to convey the sheet along the sheet conveyance path 30.

The drum-shaped photoconductor 41 is configured to rotate, and the charging device 42 charges a surface of the photoconductor 41. Furthermore, the optical scanning device 46 is configured to write an electrostatic latent image on the surface of the photoconductor 41 by scanning with laser light.

Furthermore, the developing device 43 develops the electrostatic latent image on the photoconductor 41 into a toner image. The toner image is a visible image of the toner 9. The primary transfer device 44 then transfers the toner image from the surface of the photoconductor 41 to the intermediate transfer belt 47. The primary cleaning device 45 removes the toner 9 remaining on the surface of the photoconductor 41.

It is noted that the photoconductor 41 and the intermediate transfer belt 47 are examples of an image-carrying member for holding an image of the toner 9.

The secondary transfer device 48 transfers a superimposed toner image formed on the intermediate transfer belt 47 to the sheet. The secondary cleaning device 470 removes the toner 9 remaining on the intermediate transfer belt 47. The fixing device 49 heats the superimposed toner image to fix it on the sheet.

The toner 9 removed from the photoconductors 41 and the intermediate transfer belt 47 by the primary cleaning devices 45 and the secondary cleaning device 470 is conveyed as waste developer 9*a* to the waste developer bottle 7, and is stored therein.

Furthermore, toner 9 floating inside the developing devices 43 and a portion of the carrier that has deteriorated in the developing devices 43 are also collected in the waste developer bottle 7 as the waste developer 9*a*. In other words, the waste developer bottle 7 is for storing the used waste developer 9*a*.

The waste developer bottle 7 is removably attached to a bottle attaching portion 70 of the body 1. When the waste developer 9*a* inside the waste developer bottle 7 exceeds a predetermined allowable amount, the waste developer bottle 7 is exchanged.

Meanwhile, in the toner container 5, it is desired to simplify a mechanism for feeding the toner 9 from the body 51 to the developing device 43, and save space.

In addition, when the toner 9 is fed from the body 51, pressure inside of the body 1 tends to become negative. Negative pressure inside the body 51 can interfere with feeding of the toner 9.

On the other hand, forming an opening for ventilation in the body 51 can solve the problem of negative pressure inside the body 51. However, the opening of the body 51 can cause toner leakage when the toner container 5 is being transported.

In the present embodiment, the toner container 5 has a structure that can simplify the mechanism for feeding the toner 9 from the body 51, and save space. Furthermore, the toner container 5 has a structure that can solve the problem of negative pressure inside the body 51, and the problem of toner leakage. The structure of the toner container 5 is described below.

Figure 2:
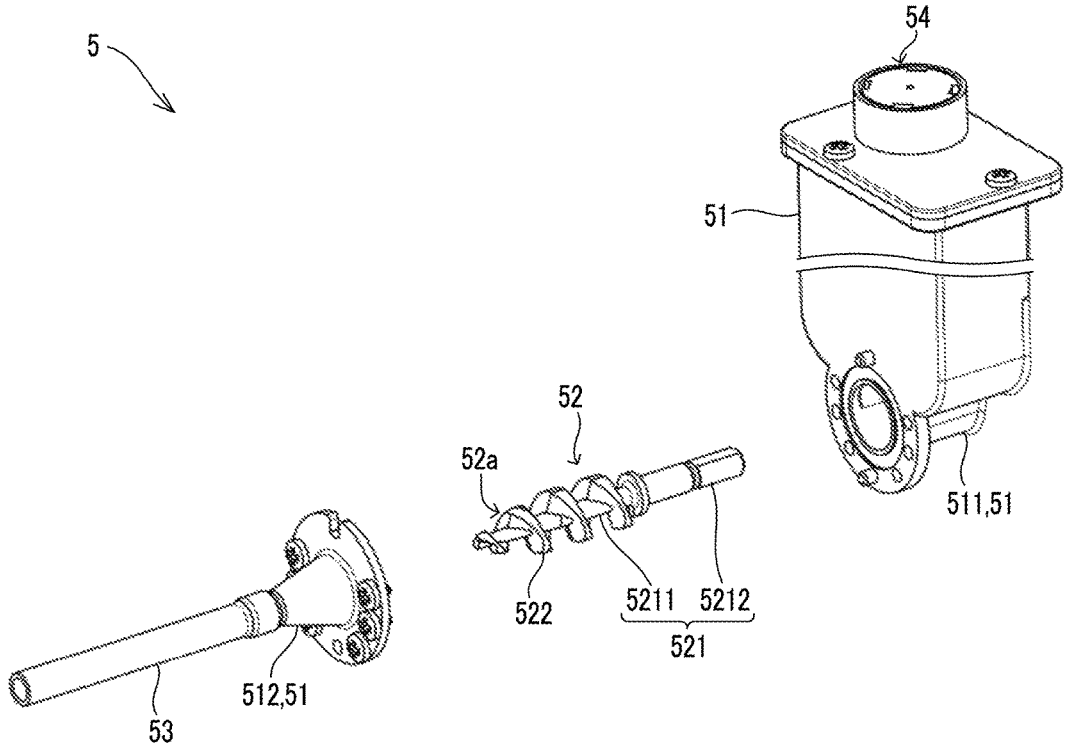
FIG. 2 is a disassembled perspective diagram of the toner container according to the first embodiment.
Figure 3:
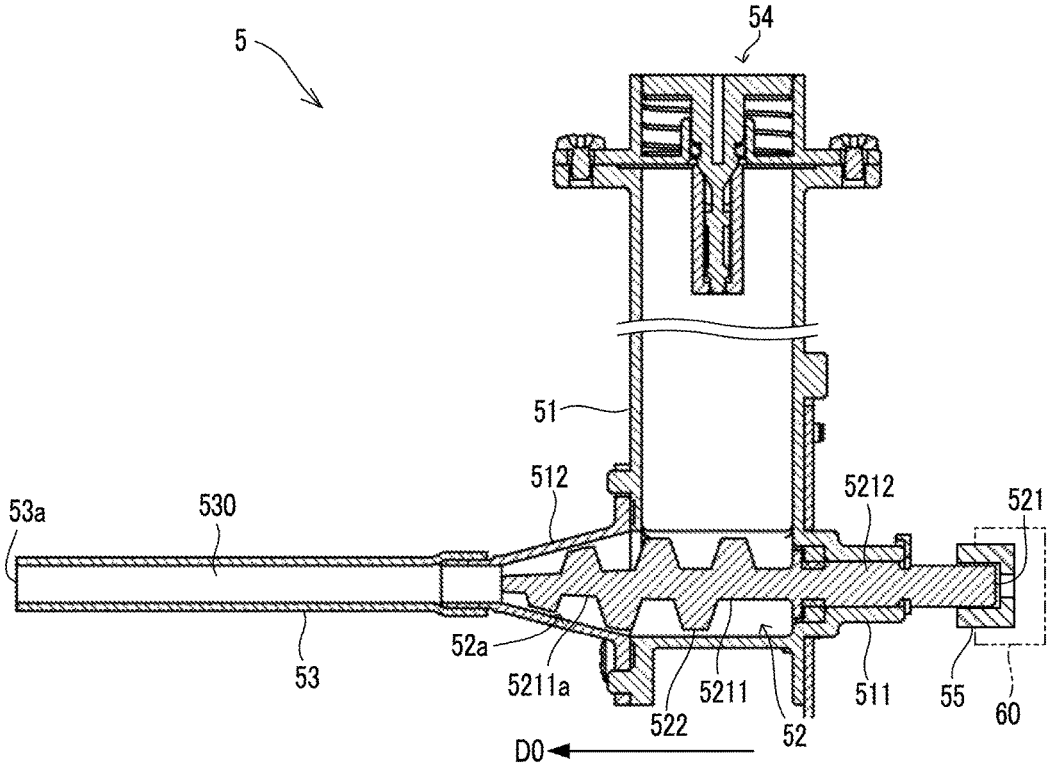
FIG. 3 is a cross-sectional diagram of the toner container according to the first embodiment.
Figure 4:
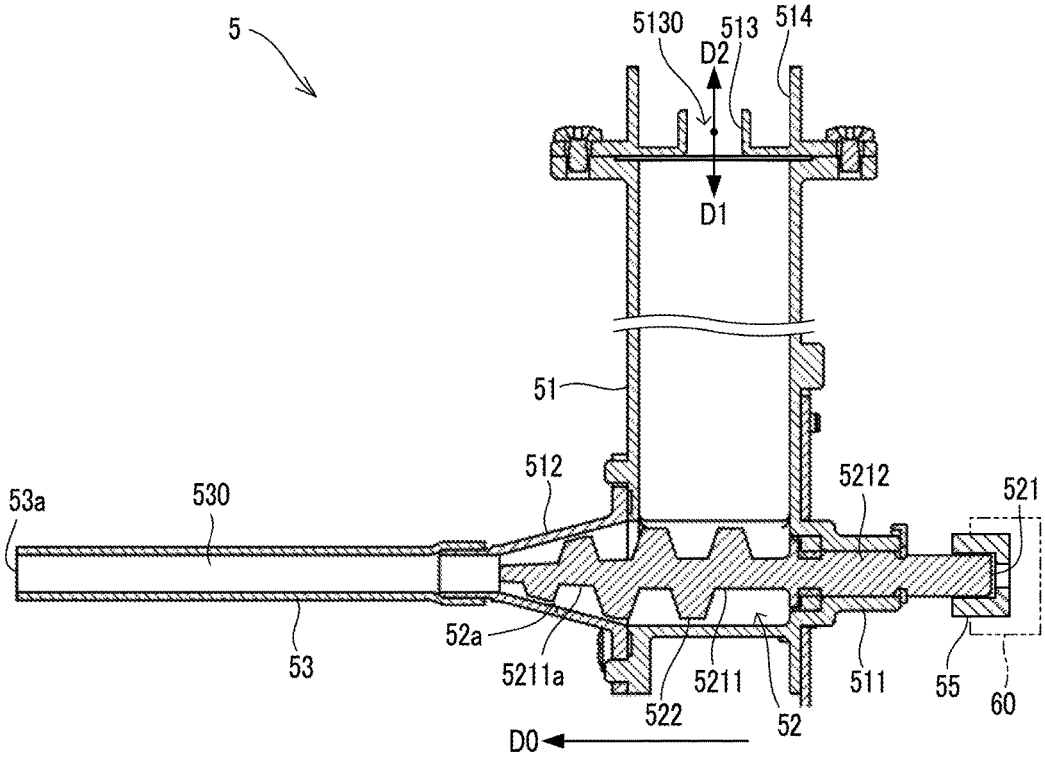
FIG. 4 is a cross-sectional diagram of the toner container with a valve removed.

As shown in FIG. 2 to FIG. 4, the toner container 5 includes the body 51, the screw feeder 52, and a tubular body 53. Furthermore, the toner container 5 includes a valve 54.

As mentioned above, the body 51 is for storing the toner 9. As shown in FIG. 3 and FIG. 4, the tubular body 53 forms a toner conveyance path 530 communicating with an inside of the body 51.

The screw feeder 52 includes a shaft 521 and a blade 522. The shaft 521 is formed extending from inside the body 51 toward an entrance of the toner conveyance path 530. The blade 522 is formed protruding spirally from the shaft 521.

As shown in FIG. 3 and FIG. 4, a lower portion of the body 51 includes a bearing portion 511 and an inner diameter tapered portion 512.

The bearing portion 511 and a portion of the body 51 that connects with the tubular body 53 are provided on opposite sides of the body 51. The shaft 521 is rotatably cantilevered by the bearing portion 511. The portion of the body 51 that connects with the tubular body 53 is the inner diameter tapered portion 512.

As shown in FIG. 2, the shaft 521 includes a first shaft portion 5211 and a second shaft portion 5212, wherein the blade 522 is only formed around the first shaft portion 5211, and not around the second shaft portion 5212. The bearing portion 511 rotatably supports the second shaft portion 5212.

A part of the second shaft portion 5212 protrudes outward from the bearing portion 511 of the body 51. An engaging member 55 is fixed on the portion of the second shaft portion 5212 protruding from the body 51. When the toner container 5 is attached to the cartridge attaching portion 6, the engaging member 55 is connected to a driving mechanism 60 provided in the body 1.

The driving mechanism 60 applies a rotational force to the shaft 521 of the screw feeder 52 via the engaging member 55. This allows for the screw feeder 52 to rotate.

A longitudinal direction in the screw feeder 52 toward the first shaft portion 5211 from the second shaft portion 5212 is a toner feeding direction D0.

The screw feeder 52 includes a contour tapered portion 52*a* in which an outer diameter of the blade 522 gradually becomes smaller in the toner feeding direction D0.

As shown in FIG. 3 and FIG. 4, a portion of the first shaft portion 5211 corresponding to the contour tapered portion 52*a* is a tapered shaft portion 5211*a*. The tapered shaft portion 5211*a* is formed tapering in the toner feeding direction D0.

The inner diameter tapered portion 512 of the body 51 is formed in a tubular shape surrounding the periphery of the contour tapered portion 52*a*, the tubular shape gradually decreasing in inner diameter in the toner feeding direction D0.

An inner diameter of the tubular body 53 is smaller than a largest inner diameter of the inner diameter tapered portion 512. In addition, the inner diameter of the tubular body 53 is smaller than a largest outer diameter of the contour tapered portion 52*a* of the screw feeder 52.

The screw feeder 52 feeds the toner 9 in the body 51 to the toner conveyance path 530 by being rotationally driven inside the body 51. With this movement, the toner 9 fills a vicinity of the entrance of the toner conveyance path 530.

Furthermore, the screw feeder 52 pushes the toner 9 that has arrived inside the toner conveyance path 530 further along the toner conveyance path 530 by feeding pressure of succeeding toner 9. This allows for the toner 9 to entirely fill the toner conveyance path 530, and to be fed out from an outlet 53*a* of the toner conveyance path 530.

It is noted that until the toner container 5 is attached to the cartridge attaching portion 6 of the body 1, a cap (not shown) is attached to the tubular body 53. This cap covers the outlet 53*a* of the toner conveyance path 530. After removal of the cap from the tubular body 53, the toner container 5 is attached to the cartridge attaching portion 6 of the body 1.

The toner 9 fed out from the toner conveyance path 530 is supplied to the developing device 43 directly, or via an intermediate conveying path (not shown).

In the example shown in FIG. 3 and FIG. 4, the tubular body 53 is a straight pipe. However, the tubular body 53 may also have a tubular shape curving downward from a horizontal direction.

As shown in FIG. 4, a vent 5130 is formed in an upper portion of the body 51. In the description below, an edge portion of the vent 5130 in the body 51 is referred to as an opening edge portion 513.

In addition, a direction through the vent 5130 from outside the body 51 toward the inside the body 51 is referred to as a first direction D1, and an opposite direction of the first direction D1 is referred to as a second direction D2 (see FIG. 4). The opening edge portion 513 is formed in a cylindrical shape that is along the first direction D1. It is noted that the opening edge portion 513 may also be formed in a square tubular shape along the first direction D1.

Furthermore, the body 51 includes a guiding portion 514 formed extending in the first direction D1 around the opening edge portion 513. In the present embodiment, the opening edge portion 513 and the guiding portion 514 are formed along concentric circles.

The valve 54 is a mechanism that switches between a closed state and an open state, wherein the valve 54 blocks the vent 5130 in the closed state, and opens a portion of the vent 5130 in the open state.

Figure 5:
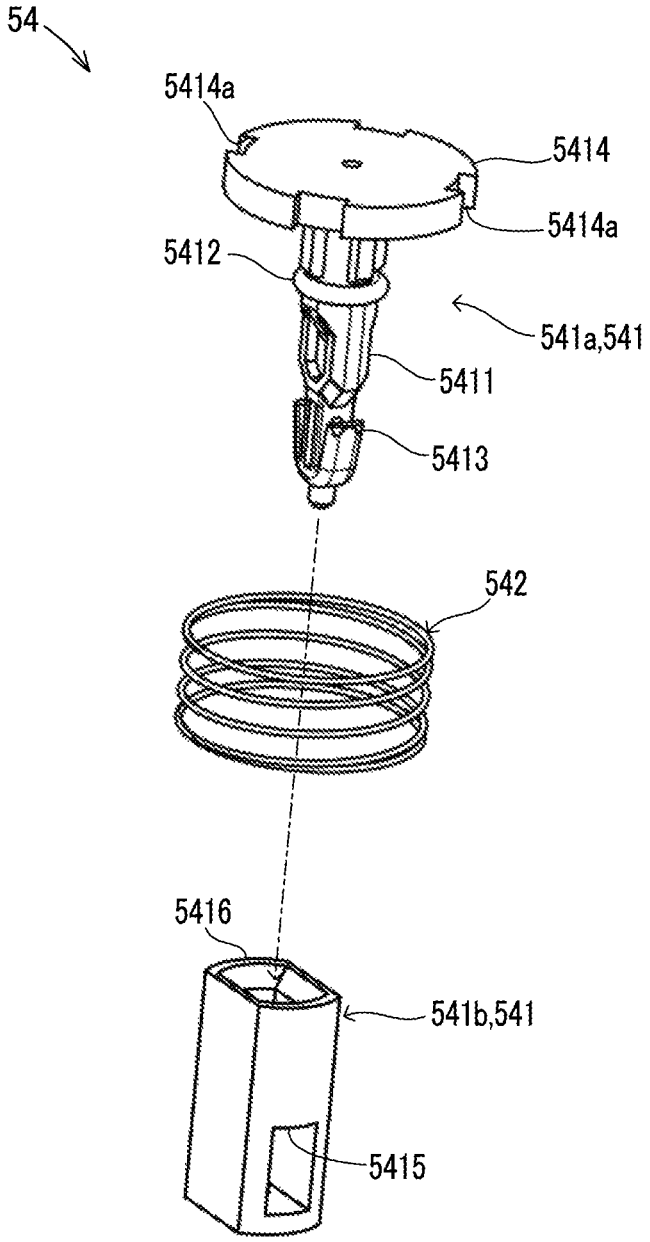
FIG. 5 is a disassembled perspective diagram of a valve included in the toner container according to the first embodiment.

As shown in FIG. 5, the valve 54 includes a first displacement member 541*a* and a second displacement member 541*b* that form an integral displacement member 541 when assembled together. Furthermore, the valve 54 also includes a spring 542.

The first displacement member 541*a* includes a penetrating portion 5411 penetrating through the vent 5130, as well as a seal portion 5412, a first engaging portion 5413, and a flange portion 5414 all provided integrally with the penetrating portion 5411.

The seal portion 5412 is provided in an intermediate portion of the penetrating portion 5411. The first engaging portion 5413 is provided near a first end of the penetrating portion 5411, and the flange portion 5414 is provided on a second end of the penetrating portion 5411.

The first engaging portion 5413 is formed on a portion of the penetrating portion 5411 positioned inside the body 51. On the other hand, the flange portion 5414 is formed on a portion of the penetrating portion 5411 positioned outside the body 51.

The second displacement member 541*b* includes a second engaging portion 5415 and a stopper 5416. The first engaging portion 5413 and the second engaging portion 5415 engage with one another to integrally hold the first displacement member 541*a* and the second displacement member 541*b* together. The second displacement member 541*b* forms a portion of the displacement member 541 positioned inside the body 51.

The seal portion 5412 is formed along an entire circumference of an outer periphery of the penetrating portion 5411. In the present embodiment, the seal portion 5412 is a circular ring member fitted in close contact with the intermediate portion of the penetrating portion 5411.

Figure 6:
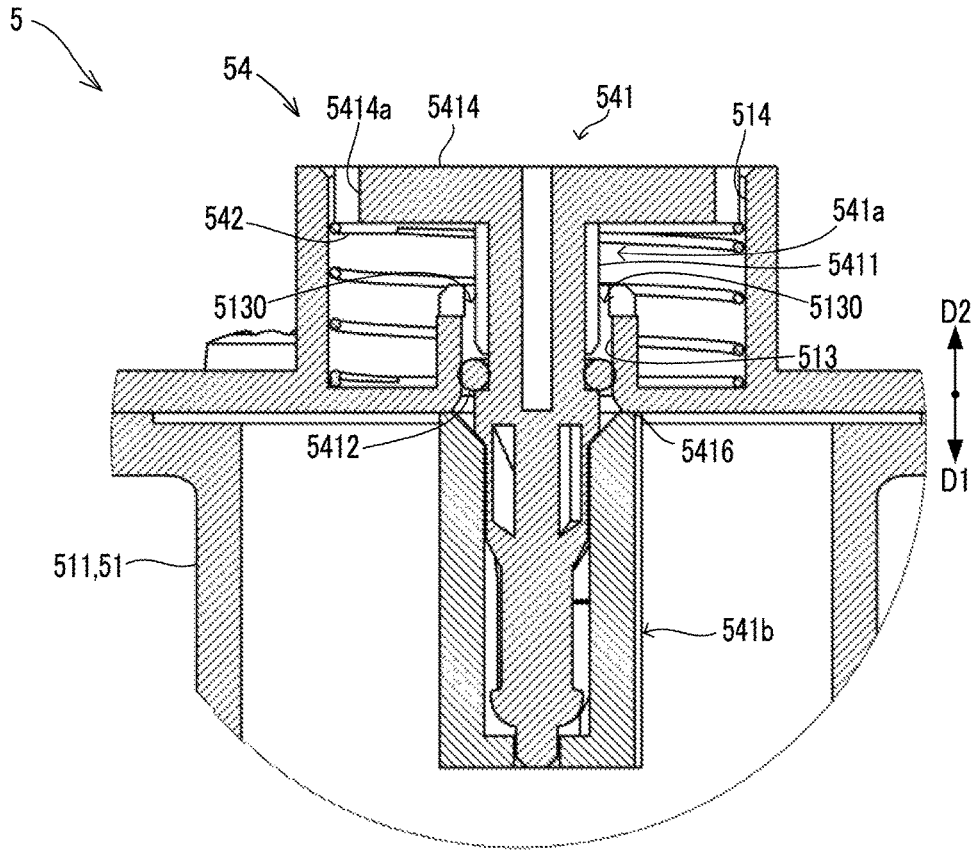
FIG. 6 is a cross-sectional diagram of a closed state of the valve included in the toner container according to the first embodiment.

As shown in FIG. 6, the seal portion 5412 of the displacement member 541 blocks the vent 5130. The displacement member 541 can be displaced in the first direction D1 and the second direction D2. It is noted that the first direction D1 is equivalent to a first displacement direction, and the second direction D2 is equivalent to a second displacement direction.

The displacement member 541 can be displaced between a closed position and an open position, wherein the seal portion 5412 blocks the vent 5130 in the closed position, and opens a portion of the vent 5130 in the open position. FIG. 6 shows the displacement member 541 in the closed position, and FIG. 7 shows the displacement member 541 in the open position.

Figure 7:
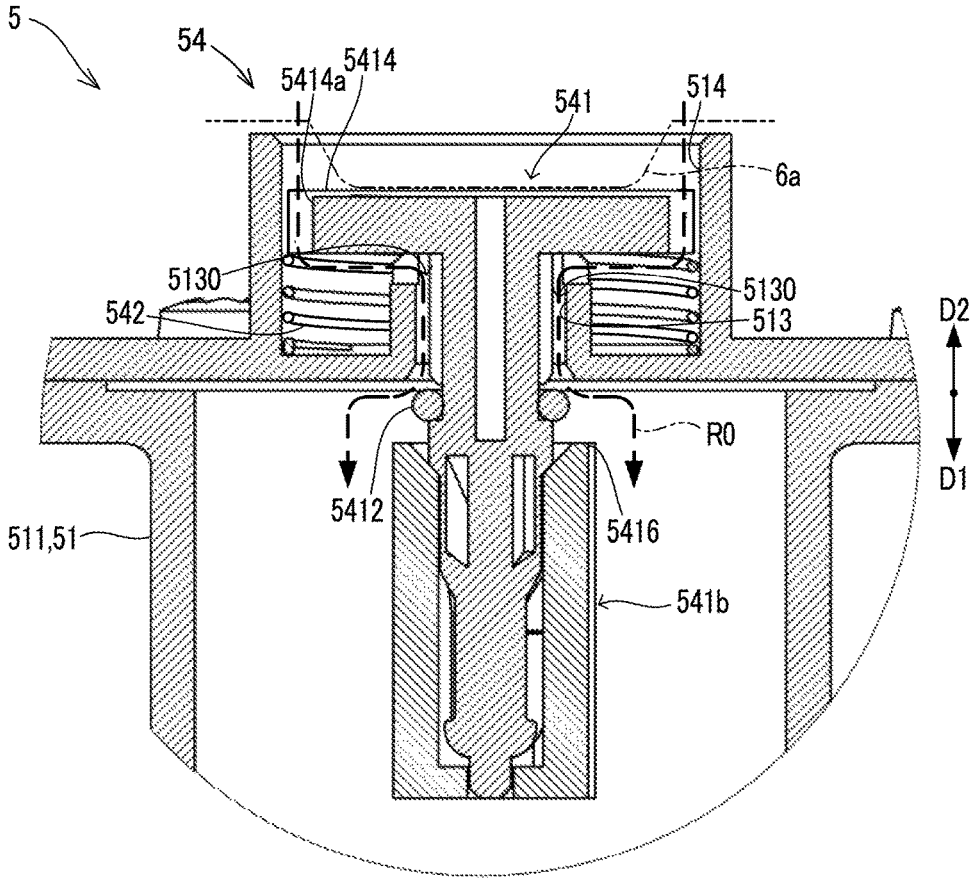
FIG. 7 is a cross-sectional diagram of an open state of the valve included in the toner container according to the first embodiment.

The guiding portion 514 guides the flange portion 5414 of the displacement member 541 in the first direction D1 and the second direction D2 (see FIG. 6 and FIG. 7). A plurality of cutout portions 5414*a* are formed on an outer edge portion of the flange portion 5414. The cutout portions 5414*a* form gaps between the flange portion 5414 and the guiding portion 514.

In addition, the stopper 5416 of the displacement member 541 abuts against an inner surface of the body 51 when the displacement member 541 is in the closed position. With this configuration, the stopper 5416 limits displacement of the displacement member 541 in the second direction D2 (see FIG. 7).

The seal portion 5412 blocks a gap between the penetrating portion 5411 and the opening edge portion 513 in the vent 5130 when the displacement member 541 is in the closed position (see FIG. 6). The seal portion 5412 blocks the gap by coming in contact with an inner peripheral surface of the opening edge portion 513.

On the other hand, when the displacement member 541 is in the open position, the seal portion 5412 opens the gap between the penetrating portion 5411 and the opening edge portion 513 in the vent 5130 (see FIG. 7). Accordingly, when the displacement member 541 is in the open position, a ventilation path R0 is formed, the ventilation path R0 communicating the outside and inside of the body 51 (see FIG. 7). The cutout portion 5414*a* forms a portion of the ventilation path R0.

In the present embodiment, a route passing through the two gaps, that is, the gap between the flange portion 5414 and the guiding portion 514, and the gap between the penetrating portion 5411 and the opening edge portion 513, is a route of the ventilation path R0.

The spring 542 holds the displacement member 541 in the closed position by applying elastic force to the flange portion 5414 of the displacement member 541. In the present embodiment, the spring 542 is a coil spring inserted inside the guiding portion 514. The spring 542 applies elastic force in the second direction D2 to the flange portion 5414 of the displacement member 541.

It is noted that the spring 542 is an example of an elastic member. Another elastic member such as rubber may also be adopted in place of the spring 542.

As shown in FIG. 7, a protruding portion 6*a* configured to abut against the flange portion 5414 of the displacement member 541 is formed on the cartridge attaching portion 6 of the body 1.

The protruding portion 6*a* holds the displacement member 541 in the open position against the elastic force of the spring 542, by abutting against the flange portion 5414 of the displacement member 541.

As described above, in conjunction with a displacement of the displacement member 541 from the closed position in the first direction D1, the seal portion 5412 is displaced from one position to another, the first position being where the seal portion 5412 blocks the gap between the opening edge portion 513 and the penetrating portion 5411 that form the edges of the vent 5130 of the body 51, and the other position being inside the body 51 away from the opening edge portion 513.

By adopting the toner container 5, it is unnecessary to provide the screw feeder 52 inside the toner conveyance path 530. This allows for the screw feeder 52 to be shortened, and to make the cylindrical body 53 narrower. Accordingly, it is possible to simplify the mechanism for feeding the toner 9 from the body 51, and save space.

In addition, by the action of the inner diameter tapered portion 512 and the contour tapered portion 52*a*, the toner 9 is smoothly fed from the body 51 to the toner conveyance path 530 in the cylindrical body 53.

In addition, when the toner container 5 is not attached to the body 1, the valve 54 blocks the vent 5130 of the body 51. This allows for the valve 54 to prevent the toner 9 from leaking from the body 51 when the toner container 5 is being transported.

In addition, when the toner container 5 is attached to the body 1, the valve 54 opens a portion of the vent 5130 of the body 51. This prevents the feeding of the toner 9 from causing negative pressure inside the body 51.

In the toner container 5, the toner 9 is conveyed in a state where the toner conveyance path 530 in the cylindrical body 53 is filled with the toner 9. In this case, the negative pressure in the body 51 disturbs the feeding of the toner 9 from the body 51. Thus, the valve 54 has a remarkable effect.

Second Embodiment

Figure 8:
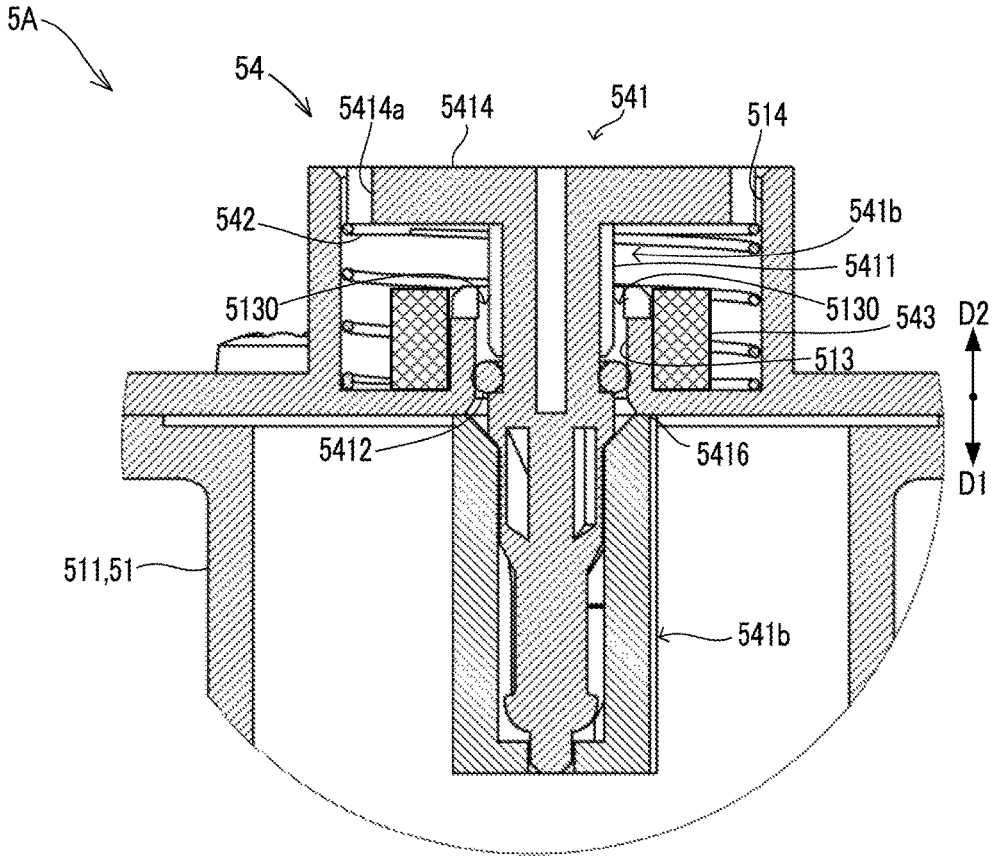
FIG. 8 is a cross-sectional diagram of a closed state of a valve included in a toner container according to a second embodiment.
Figure 9:
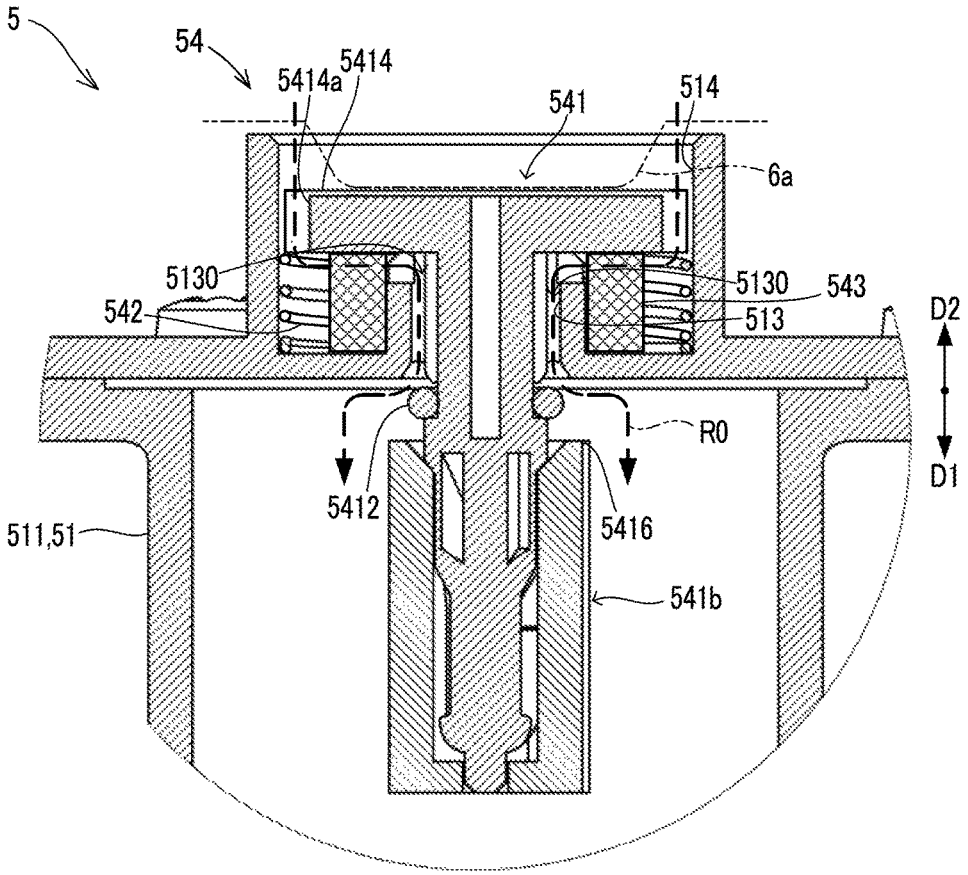
FIG. 9 is a cross-sectional diagram of an open state of the valve included in the toner container according to the second embodiment.

Next, with reference to FIG. 8 and FIG. 9, a toner container 5A according to a second embodiment is described. In FIG. 8 and FIG. 9, components that are the same as those shown in FIG. 1 to FIG. 7 are denoted by the same reference characters.

Below, a description is given of a point in the toner container 5A that is different from the toner container 5. The toner container 5A has a configuration in which a filter 543 is added to the toner container 5.

When the displacement member 541 is in the open position, the filter 543 covers a space on the outside of the body 51 communicating with the vent 5130 (see FIG. 9). The filter 543 has air permeability and can capture floating toner 9.

In the present embodiment, the filter 543 is a cylindrical member surrounding a periphery of the opening edge portion 513. When the displacement member 541 is in the open position, the filter 543 covers a gap between the flange portion 5414 of the displacement member 541 and an outer surface of the body 51.

For example, the filter 543 may be an open-cell foam sponge. The open-cell foam sponge is an example of an open-cell foam body made of an elastic material, such as rubber.

Adopting the toner container 5A achieves the same effect as in a case where the toner container 5 is adopted. Furthermore, in a state where the toner container 5A is attached to the body 1, the filter 543 prevents leaking of the toner 9 from the body 51 when the screw feeder 52 is not moving.

Application Example

In the toner container 5, the valve 54 may be omitted. In this case, the filter 543 may be fixed to the body 51 in a state where the filter 543 covers the vent 5130 of the body 51.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner container, comprising:

a container body configured to store toner;

a tubular body configured to form a toner conveyance path communicating with an inside of the container body; and a screw feeder including a shaft and a blade, the shaft formed extending from inside the container body toward an entrance of the toner conveyance path, and the blade formed protruding spirally from the shaft, wherein the screw feeder is configured to feed the toner in the container body to the toner conveyance path by being rotationally driven inside the container body, and push the toner that has arrived inside the toner conveyance path further along the toner conveyance path by feeding pressure of succeeding toner, the screw feeder includes a contour tapered portion in which an outer diameter of the blade gradually becomes smaller in a toner feeding direction, the container body includes an inner diameter tapered portion formed in a tubular shape surrounding a periphery of the contour tapered portion, the tubular shape gradually decreasing in inner diameter in the toner feeding direction, and an inner diameter of the tubular body is smaller than a largest inner diameter of the inner diameter tapered portion.

2. The toner container according to claim 1, wherein the shaft is formed tapering in the toner feeding direction in the contour tapered portion.

3. The toner container according to claim 1, wherein the shaft is rotatably cantilevered by a portion on an opposite side of a portion of the container body that connects with the tubular body.

4. An image forming apparatus, comprising:

a developing device configured to develop an electrostatic latent image on a photoconductor into a toner image; and the toner container according to claim 1 removably attached to a body storing the developing device, and configured to supply toner to the developing device.

5. A toner container, comprising:

a container body configured to store toner;

a tubular body configured to form a toner conveyance path communicating with an inside of the container body; and a screw feeder including a shaft and a blade, the shaft formed extending from inside the container body toward an entrance of the toner conveyance path, and the blade formed protruding spirally from the shaft, wherein the screw feeder is configured to feed the toner in the container body to the toner conveyance path by being rotationally driven inside the container body, and push the toner that has arrived inside the toner conveyance path further along the toner conveyance path by feeding pressure of succeeding toner, a displacement member including a seal portion configured to block a vent formed in the container body, the displacement member configured to be displaceable between a closed position and an open position, wherein the seal portion blocks the vent in the closed position, and opens at least a portion of the vent in the open position, and an elastic member configured to hold the displacement member in the closed position by applying elastic force to the displacement member.

6. The toner container according to claim 5, wherein the displacement member is configured to be displaceable in a first displacement direction and a second displacement direction, the first displacement direction going through the vent from outside to inside the container body, and the second displacement direction going in an opposite direction of the first displacement direction, the displacement member includes a penetrating portion penetrating through the vent, a stopper formed on a portion of the penetrating portion positioned inside the container body, the stopper configured to limit displacement of the displacement member in the second displacement direction by abutting against an inner surface of the container body when the displacement member is in the closed position, and the seal portion formed along an entire circumference of an outer periphery of the penetrating portion, wherein, when the displacement member is displaced from the closed position in the first displacement direction, the seal portion is configured to be displaced from a position at which the seal portion blocks a gap between an opening edge portion and the penetrating portion, to a position inside the container body away from the opening edge portion, the opening edge portion being an edge of the vent in the container body, and the elastic member is configured to apply elastic force to the displacement member in the second displacement direction.

7. The toner container according to claim 6, wherein the opening edge portion is formed in a cylindrical shape along the first displacement direction, and when the displacement member is in the closed position, the seal portion blocks the gap by coming in contact with an inner peripheral surface of the opening edge portion.

8. The toner container according to claim 5, further comprising a filter configured to cover a space on an outer side of the container body communicating with the vent when the displacement member is in the open position, the filter having air permeability and capable of capturing the toner.

9. The toner container according to claim 5, wherein the screw feeder includes a contour tapered portion in which an outer diameter of the blade gradually becomes smaller in a toner feeding direction, the container body includes an inner diameter tapered portion formed in a tubular shape surrounding a periphery of the contour tapered portion, the tubular shape gradually decreasing in inner diameter in the toner feeding direction, an inner diameter of the tubular body is smaller than a largest inner diameter of the inner diameter tapered portion, and the shaft is formed tapering in the toner feeding direction in the contour tapered portion.

10. The toner container according to claim 5, wherein the shaft is rotatably cantilevered by a portion on an opposite side of a portion of the container body that connects with the tubular body.

11. An image forming apparatus, comprising:

a developing device configured to develop an electrostatic latent image on a photoconductor into a toner image; and the toner container according to claim 5 removably attached to a body storing the developing device, and configured to supply toner to the developing device.

* * * * *